United States Patent [19]

Fenwick

[11] Patent Number: 4,603,782

[45] Date of Patent: Aug. 5, 1986

[54] ADJUSTABLE SHELF ASSEMBLY

[75] Inventor: Jay G. Fenwick, Albert Lea, Minn.

[73] Assignee: R. J. Reynolds Tobacco Company, Winston-Salem, N.C.

[21] Appl. No.: 722,622

[22] Filed: Apr. 12, 1985

[51] Int. Cl.[4] ..... A47F 5/00

[52] U.S. Cl. ..... 211/153; 108/107; 108/110; 211/187

[58] Field of Search ..... 211/153, 187, 192, 190; 108/146, 110, 111, 106, 107; 40/16.2, 574

[56] References Cited

U.S. PATENT DOCUMENTS

| | | | |
|---|---|---|---|
| 471,481 | 3/1892 | Hart | 211/153 |
| 1,778,075 | 10/1930 | Harris | 211/153 |
| 3,168,365 | 2/1965 | Evans | 211/153 X |
| 3,341,027 | 9/1967 | Mackin, Jr. et al. | 108/111 |
| 4,317,523 | 3/1982 | Konstant et al. | 211/187 |

FOREIGN PATENT DOCUMENTS

| | | | |
|---|---|---|---|
| 446299 | 1/1948 | Canada | 108/107 |
| 1185797 | 4/1959 | France | 108/110 |
| 404117 | 6/1960 | Switzerland | 211/192 |
| 2068215 | 8/1981 | United Kingdom | 108/111 |

*Primary Examiner*—Ramon S. Britts
*Assistant Examiner*—Blair M. Johnson
*Attorney, Agent, or Firm*—Grover M. Myers

[57] ABSTRACT

An adjustable shelf assembly intended primarily for use with a rack having a plurality of spaced, slotted generally vertical uprights is disclosed. The adjustable shelf assembly includes a generally planar rectangular shelf pan to which are secured front and rear shelf support tabs. The tabs at the rear of the shelf are fixed while those at the front are slideable forwardly and rearwardly with respect to the shelf pan. An actuator button is provided for each of the slideable shelf support tabs which are biased forwardly by coil springs. Rearward force applied to the actuator buttons causes the slideable forward shelf tabs to move to the rear so that the shelf can be disconnected from the rack frame.

21 Claims, 10 Drawing Figures

ADJUSTABLE SHELF ASSEMBLY

FIELD OF THE INVENTION

The present invention is directed generally to a shelf. More particularly, the present invention is directed to an adjustable shelf assembly for a merchandising rack. Most specifically, the present invention is directed to an adjustable positionable shelf assembly for a rack frame having slotted uprights. The shelf assembly includes outwardly projecting upright engaging shelf support tabs at each of its corners with the shelf support tabs at the forward corners of the shelf being spring biased forwardly. Actuating means are located adjacent the forward shelf support tabs and cooperate with these support tabs to move the tabs rearwardly with respect to the shelf upon application of force to shelf support tab actuating button portions of the actuating means. Each of the shelf support tabs is positionable in a slot in one of the uprights which forms the frame of the merchandising shelf. Depression of the shelf tab actuator buttons releases the front shelf support tabs from the slotted uprights thereby allowing the shelf assembly to be removed from the merchandising rack frame and repositioned. The merchandising rack assembly with which the present adjustable shelf assembly is intended for use is set forth in greater detail in the co-pending patent application entitled "Merchandising Rack", filed concurrently with the subject application, and assigned to a common assignee. The disclosure of that application is incorporated herein by reference.

DESCRIPTION OF THE PRIOR ART

Merchandising rack assemblies are generally well known in the art and are used to support and display various goods in retail stores. In a broader sense, rack structures generally are quite well known and are used to support, store, display, and generally house a wide variety of articles. Such rack assemblies are typically comprised of a plurality of generally vertical uprights which, in combination with horizontal tie bars form the framework within which are placed one or more generally planar, horizontally oriented shelves. Quite frequently the various shelves are attached directly to the upright frame members by some type of permanent fasteners. If the shelves are rivited or welded to the uprights, their position is obviously fixed since they cannot be moved vertically up or down the uprights. Alternatively, the shelves may require gusset type brackets that are either separate items or are welded to the shelves and which hook into the slots on the vertical uprights. These gussets typically extend down beneath the shelves and interfere with the placement of merchandise on the shelves thus requiring additional rack height while still not providing rack adjustability. This lack of adjustability limits the useages to which the rack assembly can be placed.

In an effort to provide a rack assembly which affords a degree of flexibility and which is also easier to ship and to erect at a desired point of use, various knock-down rack and shelf assemblies have been devised. In their simplier form, such rack assemblies are apt to be comprised of a plurality of uprights and tie bars which are bolted together or otherwise erected in their intended place of use to form a frame. These present rack assemblies often require back panels, welded corners, or cast metal corner fittings in order to facilitate the construction of an open frame shelf support assembly.

Shelves are then secured to the rack frame by being bolted to the uprights. While this arrangement provides a certain degree of flexibility, it is still difficult to unfasten the shelf attaching bolts, raise or lower the shelf to a new level and resecure the bolts.

To provide even greater rack flexibility, various adjustable shelf assemblies have been proposed. While these are better than the bolt supported shelves, numerous problems have limited their use. A primary requirement of an adjustable shelf is that it must be sturdy. The means used to allow the shelf to be quickly raised and lowered must also support the shelf, once it has been placed in the rack frame, in a secure manner. A shelf whose adjusting means allows the shelf to become unfastened from the frame uprights under load is certainly not acceptable. In addition to being sturdy, the shelf adjusting assembly must be easy to operate and not prone to jamming or sticking. If the shelf is not easily adjustable then the adjusting means is no better than the bolted connection that it is intended to replace. The degree of complexity of the shelf's adjustable supports must not be so great that it comprises either the rapidity of its use or its dependability.

Furthermore, the shelf adjusting assembly must be structured so that it is not inadvertently operable. While the adjusting means should be readily accessible, it should not be so exposed that it will be actuated through inadvertent or casual contact. If the shelf is released by someone accidently brushing against it, the assembly will not be satisfactory.

It will thus be seen that a need exists for an adjustable shelf, particularly intended for use with a merchandising rack assembly having a framework of slotted or otherwise apertured uprights, which is stable, durable, easy to operate yet not subject to inadvertent release, and which does not detract from the overall attractiveness and functionality of the merchandising rack assembly with which it is being used. This adjustable shelf must also be capable of being positionable in either an up or down slant position to accommodate various merchandising requirement. The merchandising rack shelf and adjustable mounting assembly in accordance with the present invention overcomes the shortcomings of the various prior devices and provides a commercially useful and functional adjustable shelf assembly.

SUMMARY OF THE INVENTION

It is an object of the present invention to provide an adjustable shelf assembly.

Another object of the present invention is to provide an adjustable shelf assembly for a merchandising rack.

A further object of the present invention is to provide an adjustable support shelf having spring biased, slidable shelf support tabs.

Still another object of the present invention is to provide an adjustable support shelf including shelf support tab actuating means.

Yet a further object of the present invention is to provide a shelf assembly for use with a merchandising rack having slotted uprights.

Still yet another object of the present invention is to provide an adjustably positionable shelf assembly which is sturdy and durable.

Yet still a further object of the present invention is to provide an adjustable shelf assembly which is not susceptable to inadvertent actuation.

An even still further object of the present invention is to provide an adjustable shelf assembly having a very thin profile with all of the shelf support hardware being located within this profile.

Still yet a further object of the present invention is to provide a thin profiled shelf assembly having sufficient strength to support the maximum loads to which it will be subjected as encountered in its preferred useage as a cigarette carton type merchandiser.

As will be set forth in greater detail in the description of the preferred embodiment, the shelf assembly in accordance with the present invention is comprised of a generally rectangular, planar shelf pan having shelf support tabs at each of the four corners of the pan. Each of these shelf support tabs is dimensioned to be receivable in an aperture or slot in one of the four generally vertically oriented uprights which together with suitable horizontal tie bars and the like forms the rack frame for the merchandising rack in which the shelf assembly in accordance with the present invention is intended to be used. The two shelf support tabs positioned at the front corners of the shelf pan are slideable in shelf support channels and are spring biased forwardly. Cooperating shelf tab actuator buttons are provided for each of the slideable shelf support tabs so that rearward motion of the actuator buttons will cause the slideable shelf support tabs to which they are connected to also move rearwardly so that the shelf can be removed from the merchandising rack frame and repositioned in the frame in a new location.

The shelf support tabs are either formed integrally with, or are slideably positioned in the shelf support channel which is, in turn, welded or otherwise rigidly secured to the sides of the shelf pan. This provides a shelf assembly that is strong and durable. The shelf supporting tabs are received in the slots or other apertures in each of the merchandising rack frame uprights. Thus the shelf is directly coupled to the uprights in a strong, load supporting manner The application of downward force to the shelf pan as the shelf is loaded will not cause the shelf support tabs to be pulled out of the uprights. Only if the shelf were overloaded to the point that it buckled and collapsed would the shelf support tabs start to pull out of the uprights. Even then, the tabs, since they are cooperatively shaped with the slots in the uprights, would tend to stay in the slots. Thus the adjustable shelf assembly in accordance with the present invention is at least as strong as its shelf pan.

Each of the slideable shelf support tabs is moveable in a simple reciprocatory motion. There is no complex linkage system or plurality of component parts that would be prone to jamming or sticking. The shelf support channels are generally U-shaped and retain the slideable shelf support tabs and actuator assemblies. In operation, a rearward pressure applied to the actuator button will cause it and its interconnected slideable shelf support tab to move straight back in the shelf support channel. This simple, direct actuating motion and structure insures that the adjustable shelf assembly will not become disabled and will operate easily and quickly when it is desired to separate the shelf from the supporting frame uprights.

The shelf pan portion of the adjustable shelf assembly of the present invention is formed at its forward portion with a ticket snap on channel that cooperates with a separate ticket support cover which receives and displays price tickets and the like. The actuator button for each slideable shelf support tab is positioned between the ticket snap on channel and the ticket support cover. In order to gain access to the actuator button, it is first necessary to reposition the ticket support cover. While this is quite easy and uncomplicated to do, it is a positive step that must be taken before the actuator button can be operated. This simple yet effective placement of the actuator button behind the ticket support cover protects the shelf from inadvertent separation from the support uprights while not unduly complicating the shelf itself.

The adjustable shelf assembly in accordance with the present invention is strong and durable, provides simple and trouble free shelf adjustability, yet prevents accidental shelf release. The shelf is clean and attractive and functions in an unobtrusive manner to support and display the various goods which may be supported and displayed on the merchandising rack assembly of which the shelf in accordance with the present invention may form a part.

BRIEF DESCRIPTION OF THE DRAWINGS

While the novel features of the adjustable shelf assembly in accordance with the present invention are set forth with particularity in the appended claims, a full and complete understanding of the invention may be had by referring to the description of the preferred embodiment, as set forth hereinafter, and as may be seen in the accompanying drawings in which:

DESCRIPTION OF THE PREFERRED EMBODIMENT

Figure 1:
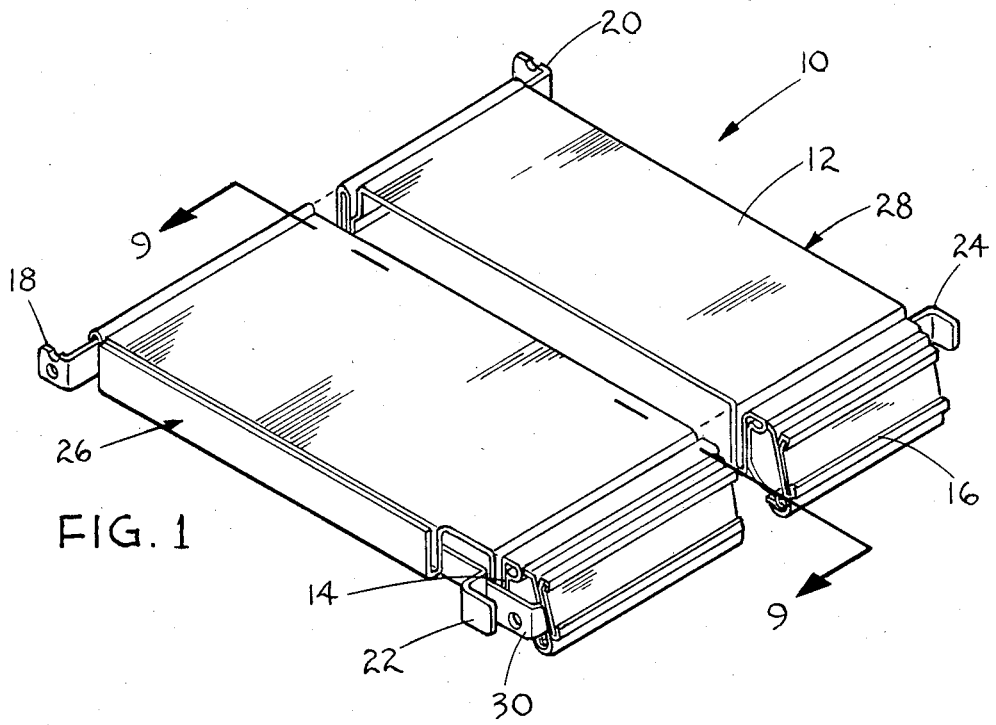
FIG. 1 is a perspective view of an adjustable shelf assembly in accordance with the present invention.
Figure 4:
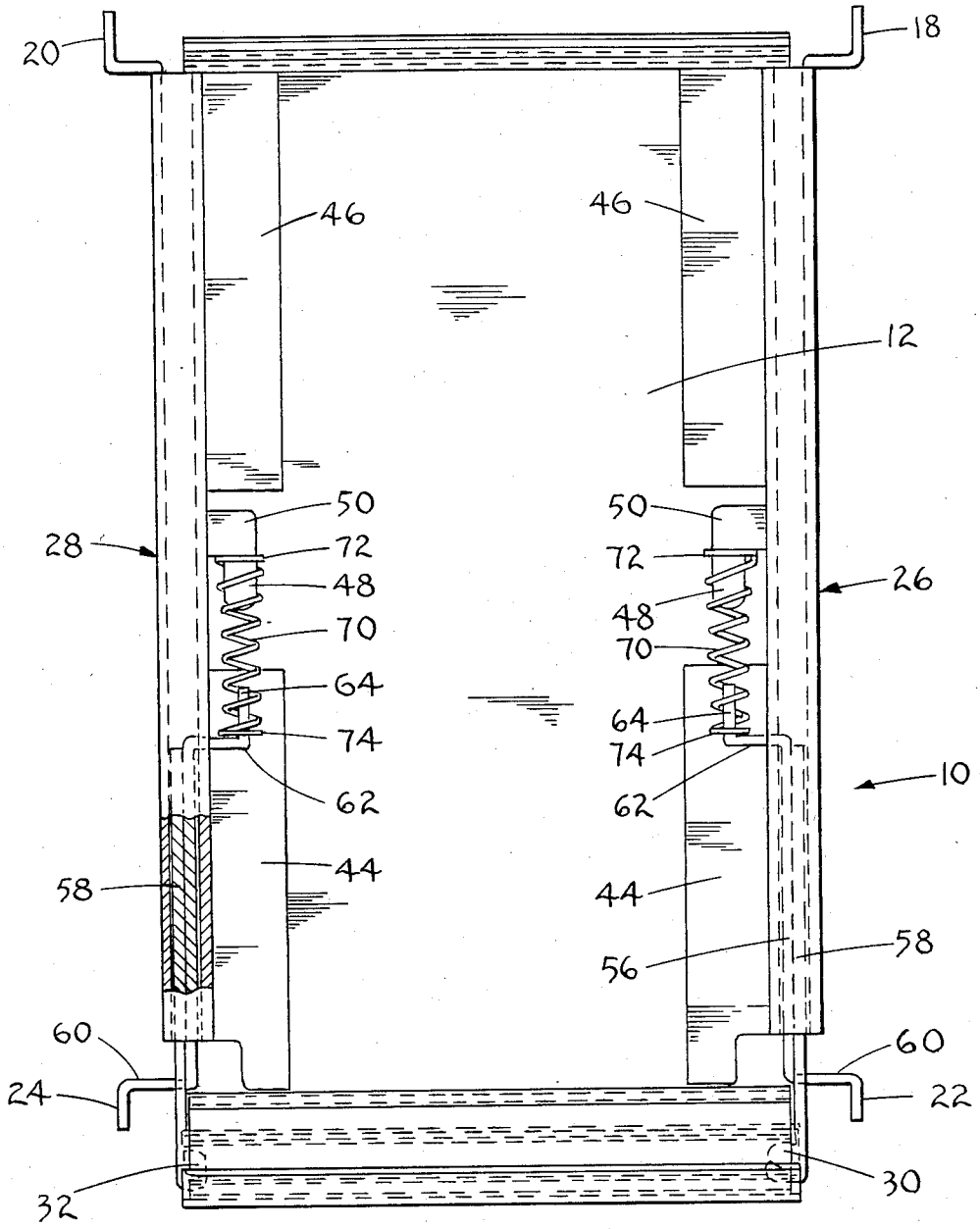
FIG. 4 is a bottom plan view of the adjustable shelf assembly.

Referring initially to FIG. 1, there may be seen generally at 10, an adjustable shelf assembly in accordance with the present invention. Shelf assembly 10 is comprised generally of a generally rectangular shelf pan 12 provided with an integral front ticket snap on channel 14 to which can be attached a price ticket support cover 16. A shelf support tab is provided at each corner of shelf pan 12 with, in the preferred embodiment, there being fixed rear shelf support tabs 18 and 20 and spring biased, reciprocatable, front shelf support tabs 22 and 24. Tabs 18 and 22 at the right side of shelf pan 12 are supported by a right support channel, generally at 26 while rear tab 20 and front tab 24 at the left of shelf pan 10 are supported by left support channel generally at 28. A right actuator button 30 is provided for the right front slideable shelf support tab 22 and, as may be seen in FIG. 4 a left actuator button 32 is provided for the left front slideable shelf support tab 24. The terms "right" and "left", "front" and "rear" are used with reference to the shelf 10 positioned as shown in FIG. 1 and are to facilitate the relative positional description of the components. In FIG. 4 which is a bottom plan view, it will be appreciated that since the shelf has been inverted from its position shown in FIG. 1 the references to "left" and "right" are reversed.

Figure 2:
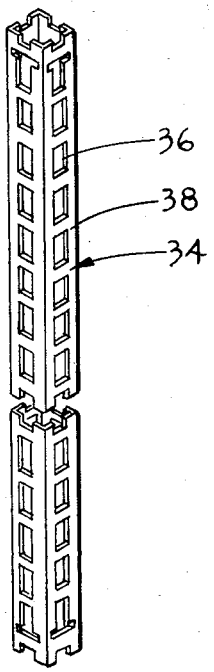
FIG. 2 is a perspective view of an upright with which the shelf support tabs of the adjustable shelf assembly cooperate.
Figure 3:
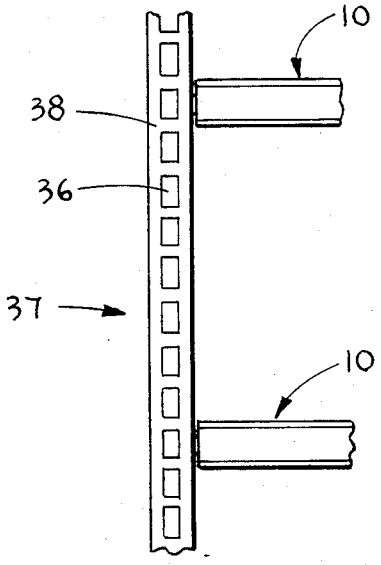
FIG. 3 is a schematic side elevation view of a portion of a merchandising rack including the adjustable shelf of the present invention.

Adjustable shelf assembly 10 is intended for use with a plurality of generally vertical uprights such as the one shown at 34 in FIGS. 2 and 3. Each such upright 34 is a generally rectangular hollow member having a plurality of elongated rectangular slots 36 in each planar face 38. Each slot 36 has a length of generally about 0.625 inch with the spacing of the slots being generally about 0.875 inch. The slot spacing provides accurate vertical shelf spacing so that the shelves can accept multiple stacks of cigarette cartons and carton types in accordance with standard industry carton sizes. A plurality of shelf assemblies 10 can be secured between several spaced uprights 34 to form a rack assembly of the type set forth in co-pending application entitled "Merchandising Rack", filed concurrently with the subject application, and assigned to a common assignee. Each shelf 10 is supported by four spaced uprights 34 by insertion of the shelf support tabs 18, 20, 22, and 24 into slots 36 in uprights 34. As will now be discussed in greater detail, the structure and operation of the shelf support tabs 18, 20, 22, and 24 and their actuator assemblies 30 and 32 facilitates the quick and simple yet secure and reliable adjustable securement of shelves 10 to uprights 34 to form a merchandising rack of the type set forth more fully in the companion application referred to above.

Figure 5:
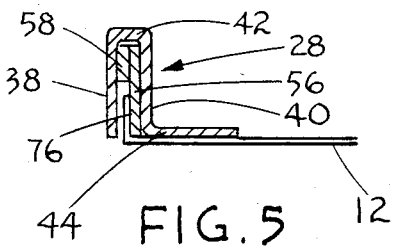
FIG. 5 is a cross-sectional view of a portion of the adjustable shelf assembly and taken along line 5—5 of FIG. 4.
Figure 6:
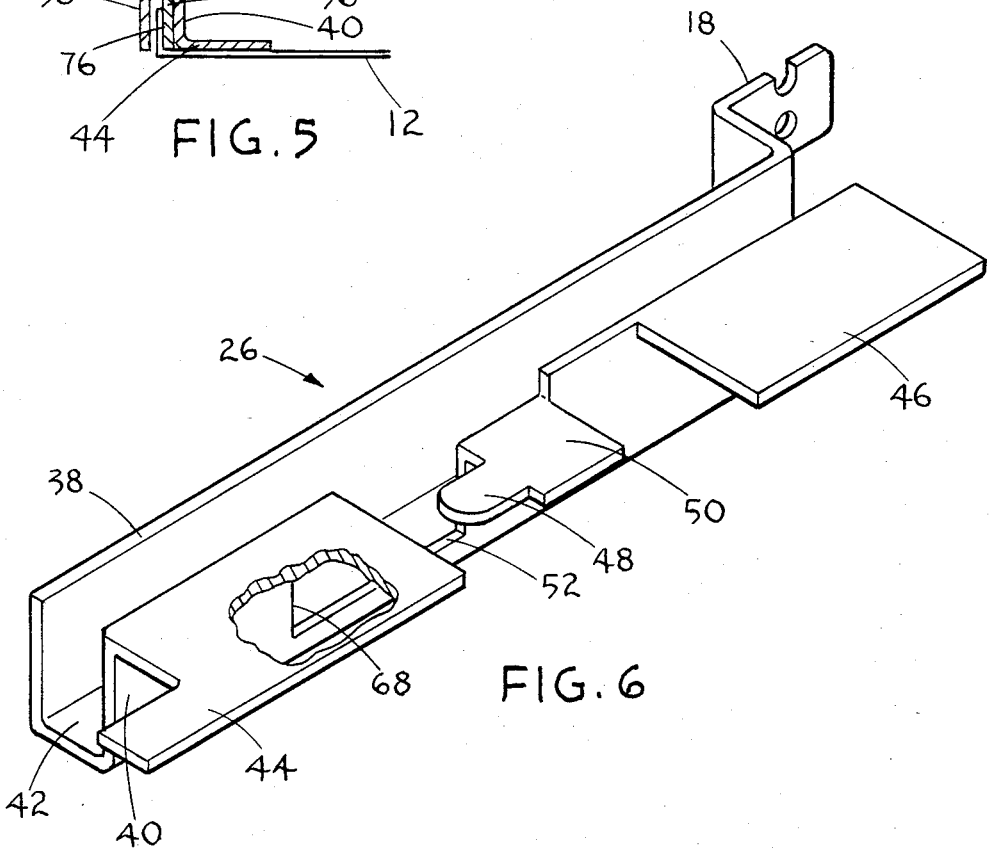
FIG. 6 is a perspective view of a support channel for the slideable shelf support tabs and actuator means of the present invention.

Turning now to FIGS. 4, 5, and 6, each shelf support channel such as the left channel 28 seen in FIG. 5 and the right channel 26 in FIG. 6 is in the form of a generally U-shaped channel having an outer vertical wall 38, an inner vertical wall 40 and an interconnecting bottom web 42. Spaced front and rear weld flanges 44 and 46 are formed as horizontal planar inwardly extending continuations nof inner vertical wall 40 of the shelf support channels 26 and 28. As may be seen in FIGS. 4 and 5, each support channel 26 and 28 is attached to the underside of shelf pan 12 by welding of pan 12 to weld flanges 44 and 46.

Figure 9:
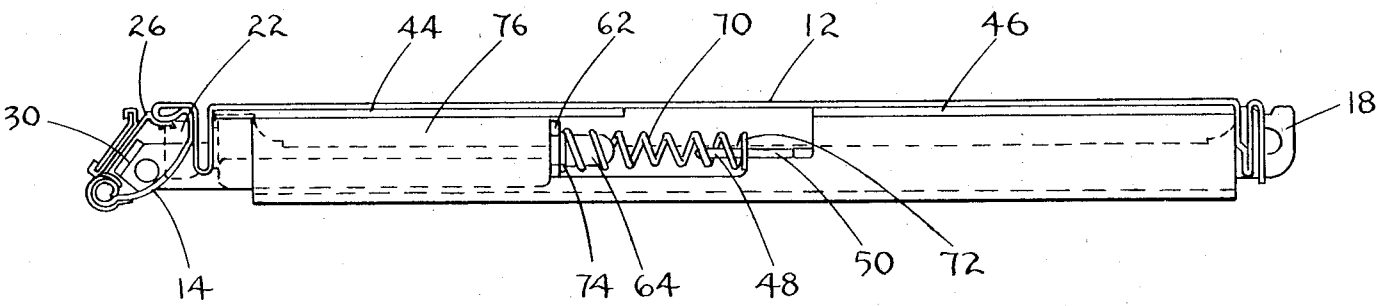
FIG. 9 is a sectional side view of the adjustable support shelf taken along line 9—9 of FIG. 1.

Fixed rear shelf support tabs 18 and 20 are formed integrally at the rear of outer vertical walls 38 of shelf support channels 26 and 28, respectively. As may be seen most clearly in FIG. 6, right rear fixed shelf support tab 18 is offset outwardly from support channel 26 a distance generally equal to half the width of face 38 of upright 34 so that the shelf pan 12 will be positioned within the inner perimeter of the rack frame defined by the four spaced uprights, generally as may be seen in FIG. 10. Rear fixed shelf support tabs 18 and 20 are generally rectangular with slightly curved lower edges, as seen in FIG. 9, and have a height and thickness slightly less than the corresponding slots 36 in uprights 34 into which they are placed. As may also be seen in FIGS. 6 and 9, each rear support tab 18, 20 has a small, upwardly turned, hook shaped upper end. This requires the shelf to be placed in an upslant position during engagement of rear tabs 18 and 20 in upright slots 36. As the shelf is then lowered to a horizontal position, the hooks prevent shelf disengagement from the uprights 34.

A fixed spring holding tongue 48 is formed as a forward portion of a spring retaining flange 50 that is located at the top of inner vertical wall 40 of shelf support channels 26 and 28 intermediate weld flanges 44 and 46. A reduced height slot 52 is formed in inner vertical wall 40, as may also be seen most clearly in FIG. 6, between front weld flange 44 and spring retaining flange 50.

Figure 7:
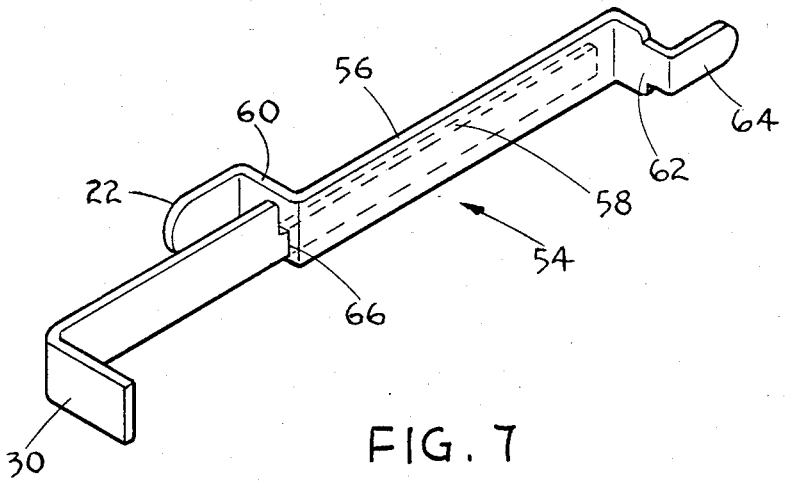
FIG. 7 is a perspective view of the slideable shelf support tab and actuator button assembly.

A slideable shelf support tab and actuator button assembly is shown generally at 54 in FIG. 7. It will be understood that assembly 54 is useable with right shelf support channel 26 and that a similar assembly, but of the opposite hand, would be provided for use with left shelf support channel 28. Shelf tab and actuator button assembly 54 is formed of two parallel metel bars 56 and 58 joined together in a parallel configuration over a majority of their lengths. Shelf support tab bar 56 has an outer offset 60 at a forward end which terminates in slideable shelf support tab 22, and an inner offset 62 at a rearward end. Inner offset 62 terminates in a sliding spring holding tongue 64. Actuator bar 58 has a forward end bent or turned inwardly generally perpendicularly to the plane of bar 58 to form actuator button 30. Actuator bar 58 passes through a slot 66 formed in the forward offset portion 60 of shelf tab bar 56 and is of reduced height once behind forward offset 60, as may be seen in FIG. 7.

In useage, as may be seen in FIGS. 4, 5, and 9, slideable shelf tab and actuator button assembly 54 is placed within right shelf support channel 26 prior to securement of support channel 26 to shelf pan 12. Support channel 26 is sufficiently wide to allow tab and actuator button assembly 54 to slide freely therewithin. Rear inner offset 62 slides within slot 52 of support channel 26 with its forward travel being limited by contact with a forward vertical edge 68 of slot 52. A coil spring 70 is placed between the slideable tab and button assembly 54 and the fixed support channel 26 by having its rear portion 72 placed about fixed spring holding tongue 48 and its forward portion 74 placed about sliding spring holding tongue 64. Spring 70 acts to force shelf tab and button assembly 54 forwardly in support channel 26 with this forward motion being limited by contact between rear offset 62 and vertical edge 68 of slot 52. Rearward pressure applied to actuator button 30 will force assembly 54 to slide rearwardly in support channel 26. Such rearward travel is opposed by spring 70 and would be limited by contact between fixed tongue 48 and slideable tongue 64.

Figure 8:
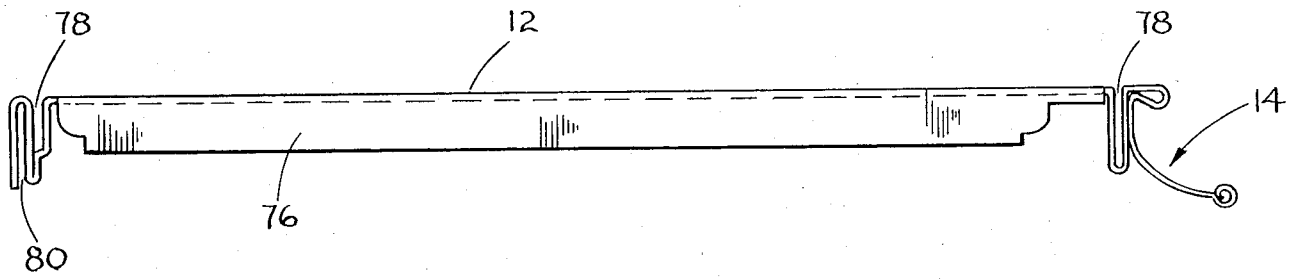
FIG. 8 is a side view of the shelf pan portion of the adjustable shelf assembly.

Shelf pan 12 is, as may be seen most clearly in FIG. 8, provided with the ticket snap on channel generally at 14 and also includes downwardly extending side flanges 76. During assembly of the shelf 10, the side flange 76 of shelf pan 12 is placed to the outside of sliding shelf tab bar 56 as seen in FIG. 5. It should be noted that flange 76 is not secured to bar 56 since the bar slides with respect to the flange 76. It should also be noted that the forward portion of shelf flange 76 is set back from the front of shelf pan 12 so as to not interfere with the sliding motion of tab and actuator button assembly 54. Shelf pan 12 may also be seen in FIG. 8 as having peripheral grooves or slots 78 and 80. As is discussed in greater detail in the companion "Merchandising Rack" disclosure, these grooves facilitate the insertion of carton divider panels, shelf blocker panels and similar assemblies.

As was previously alluded to with reference to FIG. 1, and as can be seen more clearly in FIG. 9, the actuator button 30 is placed between the ticket snap on channel 14 and its cooperating ticket support cover 16. This places the actuator button 30 in a protected location so that it cannot inadvertently be depressed by accidental or casual contact.

Figure 10:
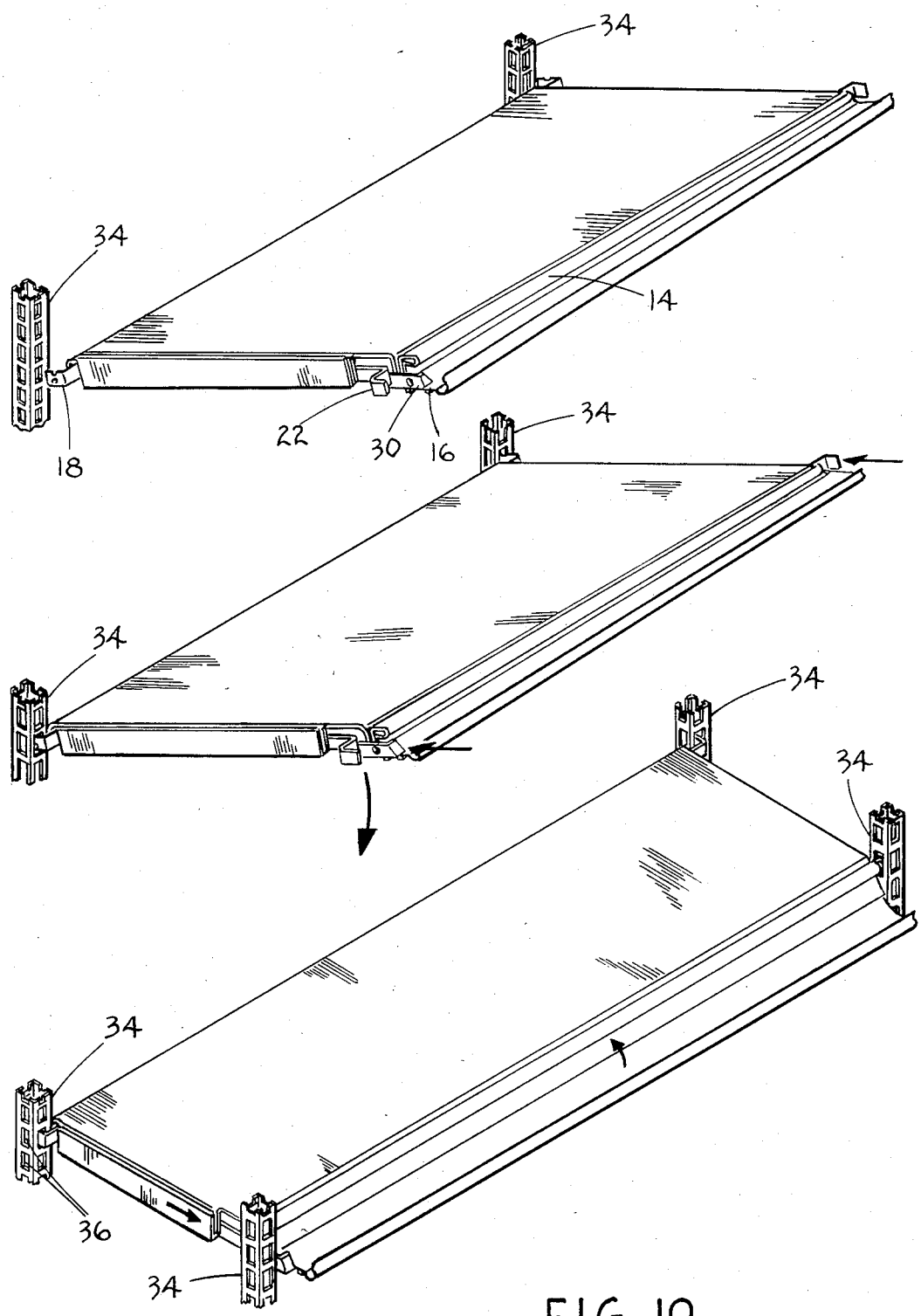
FIG. 10 is a perspective view showing the sequence of installation of the adjustable shelf assembly in accordance with the present invention.

In the operational sequence shown in FIG. 10, the adjustable shelf assembly 10 is inclined with its forward portion raised. The rear fixed sheld support tabs 18 and 20 are inserted into slots 36 in the two rear spaced uprights 34. The curved lower edge of fixed tabs 18 and 20 facilitates this insertion with the hooked upper portions of the tabs 18 and 20 preventing shelf disengagement from the uprights 34. With the ticket support cover 16 pivoted downwardly with respect to ticket snap on channel 14, access is provided to actuator buttons 30. These are concurrently depressed to move slideable front shelf support tabs 22 and 24 rearwardly in their support channels 26 and 28, respectively, against the forward bias provided by coil springs 70. Once these slideable support tabs 22 and 24 have been forced rearwardly, the forward edge of shelf 10 can be lowered until the slideable support tabs 22 and 24 are aligned with slots 36 in forward uprights 34. The actuator buttons 30 and 32 can then be released allowing springs 70 to drive the slideable tabs 22 and 24 forwardly into slots 36. Ticket cover 16 can then be pivoted up and snapped into place over ticket snap on channel 14 thereby covering the actuator buttons 30 and 32. The shelf 10 can now be used for any desired purpose with the assurance that its securement to uprights 34 is strong, secure, unobtrusive, and dependable. When shelf 10 is to be removed from uprights 34, the operational sequence set forth hereinabove is simply reversed. Thus it will be seen that the adjustable shelf assembly in accordance with the present invention provides a simple yet dependable adjustable support shelf which is rugged, attractive, uncomplicated, free from jamming and sticking, and easily attached to and removed from the frame elements of a rack assembly such as a merchandising rack.

While a preferred embodiment of an adjustable shelf assembly in accordance with the present invention has been set forth fully and completely hereinabove, it will be obvious to one of skill in the art that a number of changes in, for example, the shapes of the uprights, the shapes of the slots therein and hence the shapes of the support tabs, the size of the shelf and the like could be made without departing from the true spirit and scope of the subject invention which is therefor to be limited only by the following claims.

I claim:

1. An adjustable shelf assembly useable with a rack frame having a plurality of spaced, slotted frame members, said adjustable shelf assembly comprising:

a generally planar rectangular shelf pan defined by a front edge, a rear edge, and spaced side edges;

fixed shelf support tabs spaced along said rear edge of said shelf pan, said fixed shelf support tabs being receivable in selected slots in first ones of the frame members;

slideable shelf support tabs spaced along said front edge of said shelf pan, said slideable shelf support tabs being receivable in selected slots in second ones of the frame members;

means to bias said slideable shelf support tabs toward said front edge of said shelf pan; and actuating means for moving each of said slideable shelf support tabs away from said front edge of said shelf pan against said bias means, said actuating means including an actuating button positioned between a ticket snap on channel and a spaced, ticket support cover secured to said ticket snap on channel, said ticket snap on channel being secured to said front edge of said shelf pan whereby said slideable shelf support tabs are disengagable from the slots in said second ones of the frame members.

2. The adjustable shelf assembly of claim 1 wherein said fixed support tabs are placed at rear corners of said shelf pan and further wherein said slideable shelf support tabs are placed at front corners of said shelf pan.

3. The adjustable shelf assembly of claim 2 wherein a shelf support channel is secured to each of said side edges and extends between said front edge and said rear edge.

4. The adjustable shelf assembly of claim 3 wherein each of said fixed support tabs is formed as an integral portion of a rear portion of one of said shelf support channels.

5. The adjustable shelf assembly of claim 3 wherein each of said slideable shelf support tabs is slideably carried in one of said shelf support channels.

6. The adjustable shelf assembly of claim 5 wherein each of said shelf support channels includes a fixed spring holding tongue.

7. The adjustable shelf assembly of claim 6 wherein said actuating means for each of said slideable shelf support tabs is slideably carried in one of said shelf support channels.

8. The adjustable shelf assembly of claim 7 wherein said actuating means includes a sliding spring holding tongue.

9. The adjustable shelf assembly of claim 8 wherein said biasing means is a spring supported between said sliding spring holding tongue and said fixed spring holding tongue.

10. The adjustable shelf assembly of claim 1 wherein said ticket support cover is removabely attached to said ticket snap on channel and further wherein said actuator button is accessed by separation of said ticket support cover from said ticket snap on channel.

11. An adjustable shelf assembly adjustably securable to a rack frame having four rectangularly spaced, slotted upright frame members, said adjustable shelf assembly comprising:

a generally rectangular shelf pan having a front edge including a ticket snap on channel and spaced ticket support cover, a rear edge, and spaced side edges;

a shelf support channel secured to each of said side edges and extending generally between said front and rear edges of said shelf pan;

a fixed rear shelf support tab formed as a rear portion of each of said shelf support channels and receivable in one of the slots in a rear one of the upright frame member;

a slideable front shelf support tab slideably carried in each of said shelf support channels and projecting forwardly thereof and receivable in one of the slots in a forward one of the upright frame members;

actuating means including an actuator button for each of said front shelf support tabs, each of said actuating means being slideably carried in one of said shelf support channels with said actuator button for each of said actuating means being positioned between said ticket snap on channel and said ticket support cover; and means for biasing said slideable shelf support tabs and said actuating means forwardly in said shelf support channels.

12. The adjustable shelf assembly of claim 11 wherein each of said shelf support channels is generally U-shaped and includes spaced vertical outer and inner walls interconnected by a bottom web.

13. The adjustable shelf assembly of claim 12 wherein each of said inner vertical walls includes spaced, generally horizontal inwardly extending welding flanges which are affixed to an undersurface portion of said shelf pan.

14. The adjustable shelf assembly of claim 12 wherein each of said inner walls includes a fixed spring holding tongue and further wherein said actuating means includes a slideable spring holding tongue.

15. The adjustable shelf assembly of claim 14 wherein said means for biasing said slideable shelf support tabs and said actuating means forwardly includes a spring secured between said fixed and said sliding spring holding tongues.

16. The adjustable shelf assembly of claim 12 wherein each of said fixed shelf support tabs is formed as an offset, rearwardly extending portion of said outer vertical wall of said shelf support channel.

17. The adjustable shelf assembly of claim 11 wherein each of said slideable front shelf support tabs is a forwardly extending offset portion of a slideable support tab bar.

18. The adjustable shelf assembly of claim 17 wherein said actuator button is a forward portion of a slideable actuator bar, said support tab bar and said actuator bar being generally parallel to each other and secured to each other.

19. The adjustable shelf assembly of claim 18 wherein a rear portion of said actuator bar is an inwardly offset slideable spring holding tongue.

20. The adjustable shelf assembly of claim 19 wherein each of said shelf support channels includes a fixed spring holding tongue.

21. The adjustable shelf assembly of claim 20 wherein said biasing means is a spring secured between said slideable spring holding tongue and said fixed spring holding tongue.

* * * * *